United States Patent [19]

Wirth et al.

[11] Patent Number: 5,067,822

[45] Date of Patent: Nov. 26, 1991

[54] METHOD OF FORMING RECLOSEABLE PACKAGES, PROFILES USED THEREIN, AND PACKAGES PRODUCED THEREBY

[75] Inventors: Lawrence W. Wirth, Neenah; Wayne M. Wegner, Appleton; Mladomir Tomic, Appleton; Raymond Buchko, Appleton, all of Wis.; Johann Natterer, Bavaria, Fed. Rep. of Germany

[73] Assignee: Reynolds Consumer Products, Inc., Appleton, Wis.

[21] Appl. No.: 342,257

[22] Filed: Apr. 24, 1989

[51] Int. Cl.[5] ..... B65D 33/16

[52] U.S. Cl. ..... 383/61; 24/587; 156/66; 383/63; 493/213

[58] Field of Search ..... 24/587; 156/66; 493/213, 214; 383/61, 63, 65

[56] References Cited

U.S. PATENT DOCUMENTS

| | | | |
|---|---|---|---|
| 2,848,031 | 8/1958 | Svec et al. . | |
| 2,978,769 | 4/1961 | Harrah . | |
| 3,054,434 | 9/1962 | Ausnit et al. . | |
| 3,181,583 | 5/1965 | Lingenfelter . | |
| 3,198,228 | 8/1965 | Naito . | |
| 3,226,787 | 1/1966 | Ausnit . | |
| 3,262,634 | 7/1966 | Goodwin | 493/213 |
| 3,338,285 | 8/1967 | Jaster . | |
| 3,371,696 | 3/1968 | Ausnit . | |
| 3,416,986 | 12/1968 | Carley et al. . | |
| 3,417,675 | 12/1968 | Ausnit . | |
| 3,425,469 | 2/1969 | Ausnit . | |
| 3,460,337 | 8/1969 | Field . | |
| 3,532,571 | 10/1970 | Ausnit . | |
| 3,565,147 | 2/1971 | Ausnit . | |
| 3,608,439 | 9/1971 | Ausnit . | |
| 3,619,395 | 11/1971 | Skendzic . | |
| 3,839,128 | 10/1974 | Arai . | |
| 3,948,705 | 4/1976 | Ausnit . | |
| 3,953,661 | 4/1976 | Gulley . | |
| 4,003,972 | 1/1977 | Herz . | |
| 4,118,166 | 10/1978 | Bartrum . | |
| 4,189,809 | 2/1980 | Sotos . | |
| 4,212,337 | 7/1980 | Kamp . | |
| 4,235,653 | 11/1980 | Ausnit . | |
| 4,240,241 | 12/1980 | Sanborn . | |
| 4,246,288 | 1/1981 | Sanborn . | |
| 4,285,376 | 8/1981 | Ausnit | 383/61 |

(List continued on next page.)

FOREIGN PATENT DOCUMENTS

| | | | |
|---|---|---|---|
| 0276554 | 8/1988 | European Pat. Off. . | |
| 0302144 | 8/1989 | European Pat. Off. . | |
| 2613326 | 10/1988 | France | 383/63 |
| 1546433 | 5/1979 | United Kingdom . | |
| 2080412A | 2/1982 | United Kingdom . | |

OTHER PUBLICATIONS

Brochure from Bayer AG entitled "Durethan: Nylon 6 and 66, Bayer Engineering Plastics", published 1979.

Brochure from Monsanto entitled "Vydyne Engineering Thermoplastic Resins", published 1983.

*Primary Examiner*—Stephen P. Garbe

*Attorney, Agent, or Firm*—Willian Brinks Olds Hofer Gilson & Lione

[57] ABSTRACT

A method of forming a recloseable package using special profile strips, the strips themselves and a resulting package are disclosed. The profile strips have a flange element and a recloseable element, and two mated profile strips are provided with a heat barrier.

The method comprises the steps of providing mated top and bottom profile strips, providing top and bottom package films on opposite sides of the mated strips and applying heat and pressure to the films adjacent the flanges sufficient to simultaneously form heat seals respectively between the top film and the top profile strip flange and between the bottom film and bottom profile strip flange. The heat barrier may comprise a thickened flange element, buffer strip or a coextrusion of high temperature resin on the inside layer of the flange element. The heat barrier prevents the flanges from fusing together during the formation of flange-film seals.

23 Claims, 2 Drawing Sheets

U.S. PATENT DOCUMENTS 4,379,806 4/1983 Korpman .
4,419,159 12/1988 Herrington .
4,428,788 1/1984 Kamp .
4,430,070 2/1984 Ausnit .
4,437,293 3/1984 Sanborn .
4,497,678 2/1985 Nussbaum .
4,498,939 2/1985 Johnson .
4,515,647 5/1985 Behr .
4,528,224 7/1985 Ausnit .
4,540,537 9/1985 Kamp .
4,555,282 11/1985 Yano .
4,561,109 12/1985 Herrington .
4,582,549 4/1986 Ferrell .
4,584,201 4/1986 Boston .
4,589,145 5/1986 Van Erden et al. .
4,601,694 7/1986 Ausnit ..... 493/214
4,617,683 10/1986 Christoff .
4,656,075 4/1987 Mudge .
4,664,649 5/1987 Johnson et al. ..... 493/381
4,666,536 5/1987 Van Erden et al. .
4,673,383 6/1987 Bentsen .
4,682,366 7/1987 Ausnit et al. .
4,698,118 10/1987 Takahashi .
4,709,533 12/1987 Ausnit ..... 383/61
4,736,451 4/1988 Ausnit .
4,755,247 7/1988 Mudge .
4,755,248 7/1988 Geiger et al. .
4,782,951 11/1988 Griesbach et al. .
4,786,190 11/1988 Van Erden et al. .
4,817,188 3/1989 Van Erden .
4,835,835 6/1989 Gould .
4,925,318 5/1990 Sorensen .

METHOD OF FORMING RECLOSEABLE PACKAGES, PROFILES USED THEREIN, AND PACKAGES PRODUCED THEREBY

BACKGROUND OF THE INVENTION

This invention relates to a method of forming recloseable packages, profile strips used in the method and packages produced thereby. More particularly, the invention relates to recloseable packages which are made from two film layers hermetically sealed at the periphery of the package and sealed to profile strips having recloseable means elements formed thereon.

A common method of packaging foods such as sliced luncheon meats and the like is by use of horizontal form, fill and seal procedures. In that procedure, a bottom film is placed horizontally over a piece of equipment having a cavity the general size and shape of the article to be packaged. Heat is applied and a vacuum is drawn in the cavity, forcing the bottom film into the cavity. The food article is placed inside the film-lined cavity, and a top film is placed over the article. Heat seals are made between the top and bottom films, often while the resulting package is being evacuated to produce vacuum packed food products.

There has been a recent interest in providing food packages of the type thus produced with recloseable seals. In this regard, see U.S. Pat. No. 4,782,951, which is incorporated herein by reference. Recloseable food packages are generally made from separate films and extruded profile strips, though some suggestion of films with integral recloseable means may be found in the art. In the more common practice, the separate profile strips each comprises a flange and an integral interlocking member. The profile strips are formed by two separate extrusions or through two separate openings of a common extrusion die. One profile strip may have a rib or male member and the other a mating groove or female member. The male or female member extends from the front face of the flange member. The rib and groove form a pressure fastenable and releasable closure mechanism. The back side, or sometimes an extended portion of the front face of the flange, is sealed to the package film so that the closure mechanism is disposed between the package walls adjacent the openable side of the package.

Though there has been some suggestion for applying the profile to the film as soon as the profile is extruded, the more common practice is to wait to apply the profile strips to the film at the time the film is made into packages. In that case, the profile strips are extruded, mated, and rolled up for storage. When used on a horizontal form, fill and seal machine, the profile strips are unwound from storage rolls and sealed to the films used to make the packages.

There have been two procedures for applying the profile strips to the films. In the less common procedure, the profile strips are unwound from storage spools and unmated. Each strip is then independently sealed to the packaging film. One procedure of doing this is to blow hot air on the back of the profile to heat it to its softening point. It then has to be immediately pressed into contact with the film. The primary difficulty encountered with this procedure is getting the combined film/profile strips in proper alignment after the cavity is formed in the bottom film, a product is placed therein and it is time to join the two films.

Due to the difficulty in remating the interlocking members once the profile strips are attached to the film, another more complicated process used is to seal the mated profile strips to the film one flange at a time. In this regard, the equipment manufacturers have developed form, fill and seal machines in which a plow element is used to separate the flange segments of the mated profile strips without disengaging the rib and groove. A heat seal is then made between the bottom film and the back side of the flange of the bottom profile strip. After the food product is inserted into the film-lined cavity and the top film put in place, a plow arrangement is again used to separate the flanges so that the flange of the top profile strip can be sealed to the top film. Heat seals are also made around the rest of the package edges. The primary problem with this procedure is that the equipment is more complicated, a sealing step has to be performed in at least two different places in the process. However, machine manufacturers Klockner-Hooper of Itasca, Ill. and T.W. Kutter of Avon, Mass., have produced machines with the plow arrangement.

SUMMARY OF THE INVENTION

In accordance with the present invention, a method of producing recloseable packages has been developed in which the heat seals between the flanges of the profiles and the films can be made simultaneously, and also simultaneously with the formation of the peripheral package heat seals.

In this regard, the method comprises the steps of providing a mated top and bottom profile strip, each comprising cooperating means for forming a recloseable seal and a heat sealing flange, the profile strips further comprising a heat barrier between the flanges; providing a top and bottom film on opposite sides of the combined profile strips; applying heat and pressure to the films adjacent the flanges sufficient to simultaneously form heat seals respectively between the top film and top profile strip flange and between the bottom film and bottom profile strip flange; and forming remaining seals between the films to seal the package.

The heat barrier serves the function of preventing the heat which seals the flange-film layers together from sealing the two flanges together. Three different presently preferred heat barriers are 1) a thickened flange, 2) a strip of buffer or insulating material, and 3) a high temperature resin coating on the flange's inside layer.

The machinery used in the process of the present invention, and its operation, are much simplified. No plows are required in the equipment to separate flange members for sealing. All sealing steps can be performed at the same time and at the same machine station. A double profile arrangement may be used to allow product filling on both sides of the center of a web of film where the double profiles are sealed.

The invention and its advantages will best be understood in reference to the drawings and detailed description of the preferred embodiment.

DETAILED DESCRIPTION OF THE PREFERRED EMBODIMENTS OF THE INVENTION

Figure 1:
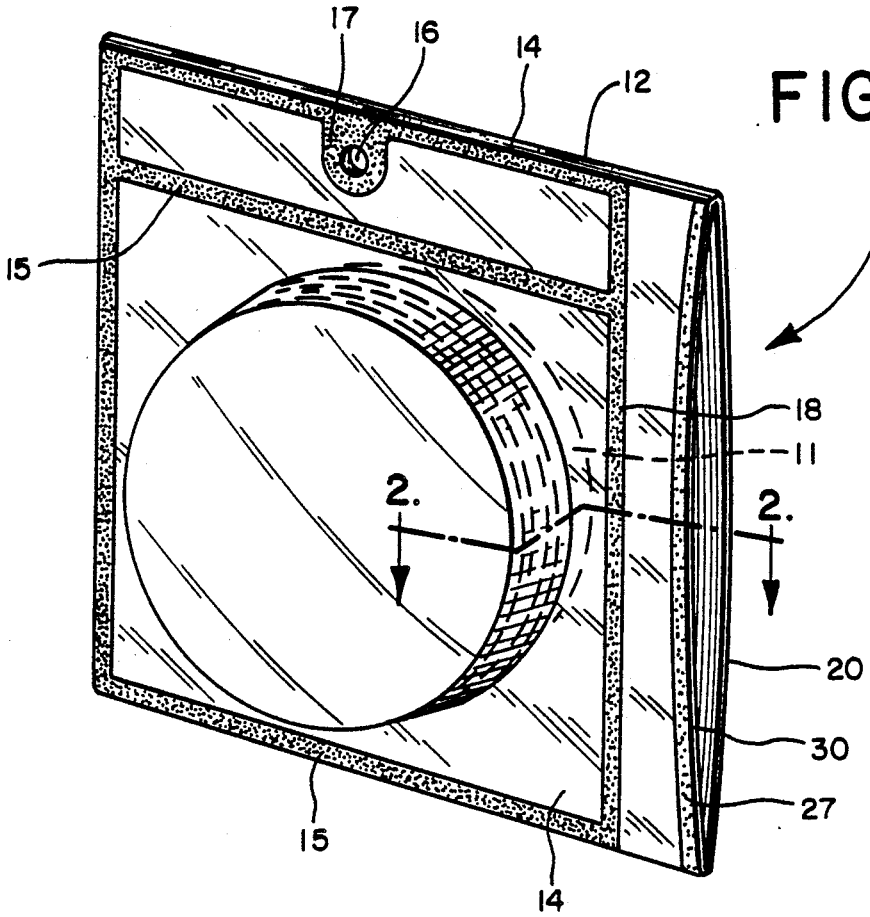
FIG. 1 is a perspective view of a preferred embodiment package of the present invention.

Shown in FIG. 1 is a recloseable package 10 of the preferred embodiment of the invention. As shown, package 10 contains a sliced luncheon meat produce. The package can of course be used for any number of foods or even non-food items, and shaped appropriately.

Figure 2:
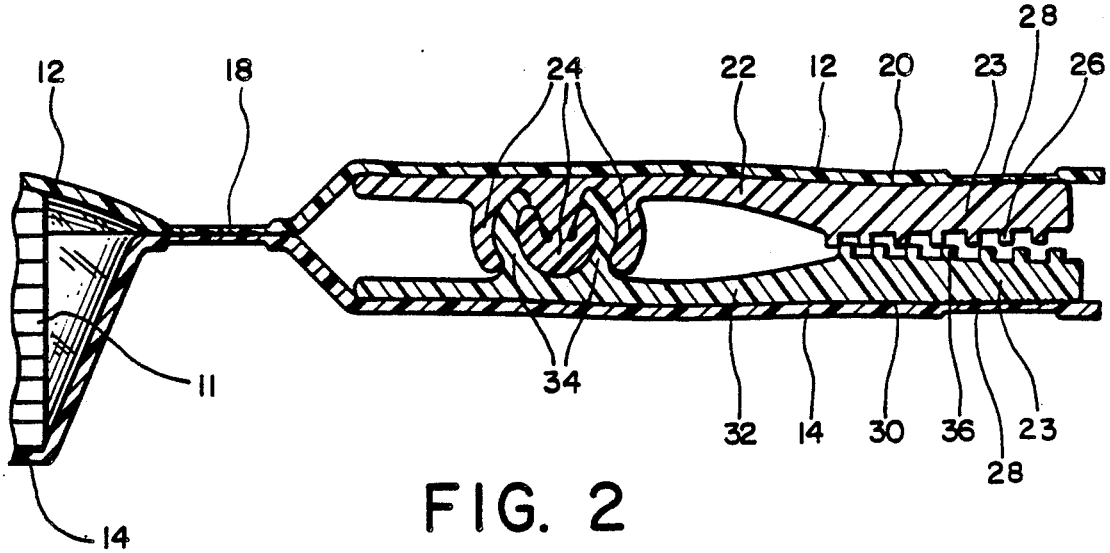
FIG. 2 is a sectional view taken along line 2—2 of FIG. 1.

The package 10 is made from a top film layer 12, a bottom film layer 14, and two profile strips 20 and 30, best seen in FIG. 2. The two films are sealed around the peripheral sides by heat seals 15. Also, a peg hole 16 is formed in the package 10, with another seal 17 formed at the top edge and around the hole 16. The seal 18 between the product 11 and recloseable opening of the package is a peel seal. The seals 15 and 18 hermetically seal the package during distribution and sale. After purchase, a consumer separates the recloseable seal and the peel seal 18, leaving the peripheral seals intact. After removing a portion of the product, the profile strips 20 and 30 (described more fully below) may be used to form a recloseable seal to help maintain freshness of the unused product 11.

Figure 3:
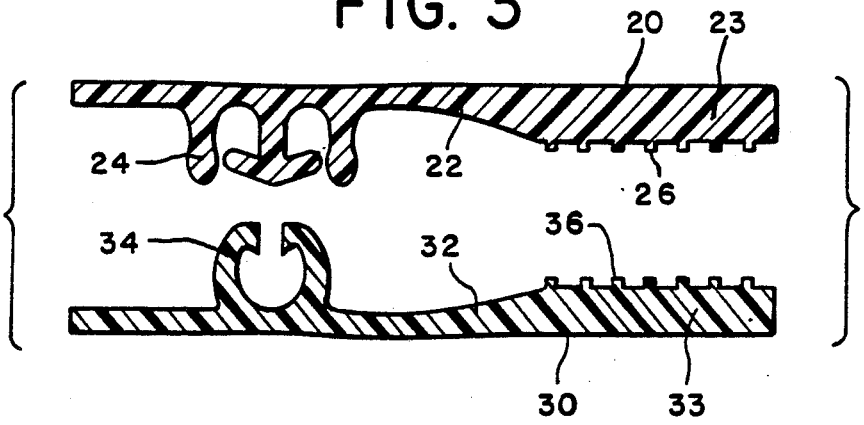
FIG. 3 is a cross sectional view of the unmated profile strips used in the package of FIG. 1.

The profile strips 20 and 30, best seen in FIG. 3, include, respectively, flange elements 22 and 32, and recloseable means elements 24 and 34. The recloseable means elements 24 and 34 may be interlocking rib and groove members as shown, or may take other forms known in the art. A preferred shape of the interlocking rib and groove members is disclosed in U.S. Pat. Nos. 3,038,225 and 3,198,228, incorporated herein by reference.

The profile strips 20 and 30 each have a heat barrier means associated with the inside face or front side of the flange elements 22 and 32. In the preferred embodiment shown in FIG. 3, the heat barrier means comprises thickened sections, 23 and 33, of the flange elements 22 and 32. The heat barrier means in this embodiment is the mass of the thickened section 23 or 33. The thickened sections 23 and 33 are sufficiently thick so that films 12 and 14 may be simultaneously sealed respectively to the back sides of flange elements 22 and 32, while the interlocking elements are mated, without also fusing the flange elements 22 and 32 of the mated profile strips 20 and 30. In this embodiment, the thickened sections 23 and 33 act as a heat sink so that only the back side surface of the flange elements 22 and 32 gets hot enough to fuse to the films 12 and 14.

Even though the inside faces of flange elements 22 and 32 do not fuse together, experimentation with the invention has shown that the flanges are often difficult to separate after the film-profile sealing process. It has been found that ridges 26 and 36 provided on the front face respectively of the flange elements 22 and 32 hold the flange elements 22 and 32 apart from each other, making it easier to separate the flange elements when opening the package 10. It is also speculated that the thickness added to the flange by the ridges helps prevent sealing of the flanges.

The package 10 is formed in a horizontal form, fill and seal machine. The machine is similar to those produced by Klockner-Hooper and T.W. Kutter. Another machine manufacturer, Multivac of Kansas City, Mo., has been developing simplified equipment to take advantage of the benefits of the present invention. Such a machine is sold by Multivac as their RT5200 packaging machine. The machine operation is similar to that described above, except simplified. The profile strips 20 and 30 are provided with their respective recloseable means elements 24 and 34 mated. After the product 11 is in place, on the bottom film 14, the mated profile strips, 20 and 30, and the top film 12 are supplied, the mated profile strips of course being sandwiched between films 12 and 14. Heat and pressure are applied to the films 12 and 14 adjacent the profile flange elements 22 and 32 sufficient to simultaneously form heat seals 27 and 28 respectively between the top film 12 and back side of flange element 22 and between the bottom film 14 and back side of flange element 32. In the preferred process, these heat seals are made at the same time and in the same machine position that seals 15, 17 and 18 are made and the package 10 is evacuated (in the case of vacuum packaged food products).

Figure 4:
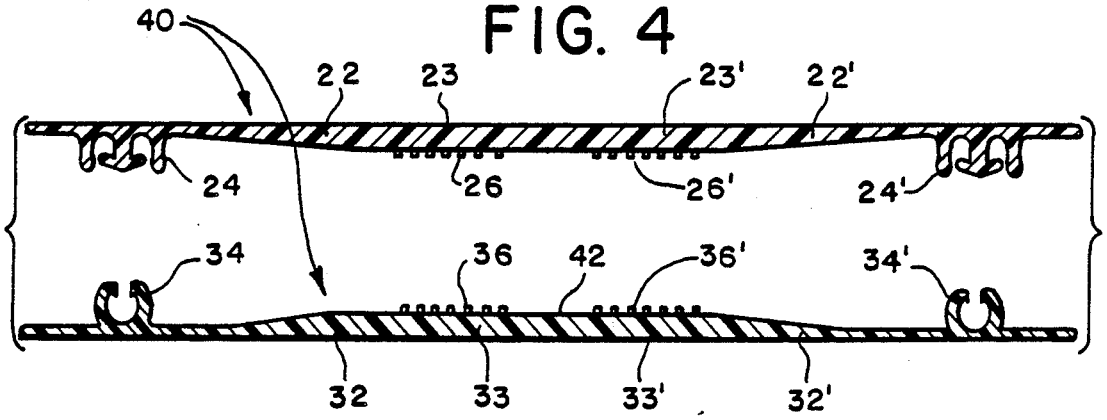
FIG. 4 is a cross sectional view of a double profile version of the profile of FIG. 3.

FIG. 4 shows a double wide embodiment of the profile strips 40. These double wide profiles may be used in equipment that packages multiple lines at the same time. The profile strips of the left-hand side of FIG. 4 correspond exactly to the profile strips 20 and 30 of FIG. 3, and are thus labeled accordingly. The profile strips on the right-hand side of FIG. 4 are a mirror image of those in the FIG. 3, and all elements are identified with primed (') designations. The only difference is that flange element 32 and 32' are connected by a bridging section 42 formed when the profile strips are extruded.

When the double wide strips 40 are used, the two sets of profile strips remain connected until the films have been sealed to the profiles. Then a knife is used to sever bridging section 42 to separate resulting completed packages. The form, fill and seal procedure is otherwise identical to that described for the profiles of FIG. 3 except the procedure is in duplicate, side by side.

Figure 5:
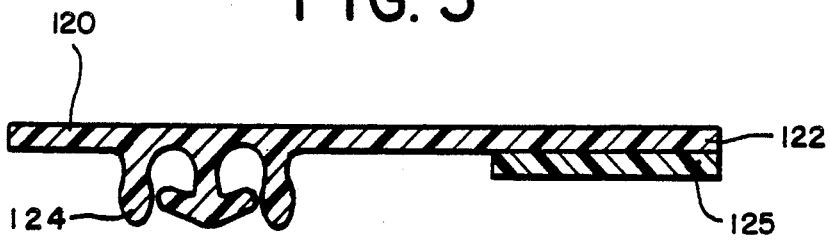
FIG. 5 is a cross sectional view of a second embodiment of a profile strip that may be used in the package of FIG. 1.

FIG. 5 shows one part of another preferred embodiment of the present invention, profile strips 120 (a matching profile strip such as strip 30 of FIG. 3 would also be provided). Profile strip 120 is very similar to the profile strip 20 of FIG. 3 (thus similar elements are numbered with the same reference numbers preceded by a 1). In the embodiment of FIG. 5, however, the heat barrier means comprises a buffer or insulating material 125. In order to keep it in its proper position, the buffer material 125 should be adhered to the front face of one (or even both) of the flange elements 122 and its counterpart (not shown).

The buffer material 125 may be paper, foil, metalized plastic, plastic or the like. If a plastic insulating layer is used, it should have a higher softening point than that of the resin of which the flange element 122 is made. The buffer material 125 may be adhered to the profile flange while the flange element is still hot after extrusion, or adhered by an adhesive later, but preferably before the profile strips are mated. As noticed from the drawings, in this embodiment the flange element 122 need not be as thick as the flange element 22 of the FIG. 3 embodiment. Also, the buffer strip 125 prevents the two front faces of the flange elements from sticking together.

Therefore there is little need for the ridges 26 and 36 found in the FIG. 3 embodiment.

The preferred embodiment of the buffer strip may be used with the double wide profile strips arrangement such as FIG. 4. In that case, the buffer strip is placed in the space between the profile strips. By using a buffer strip which has a first surface which is sealable to either of the flange member and a second surface which is sealable to neither of the flange members, when the film-profile seals are formed the buffer strip 125 adheres to one of the flange members. In this way the flanges do not fuse. Also, the buffer strip 125 need not originally be adhered to the flange members, it will still not be free to fall on the floor or interfere with equipment operation when the double wide profiles are slit.

Figure 6:
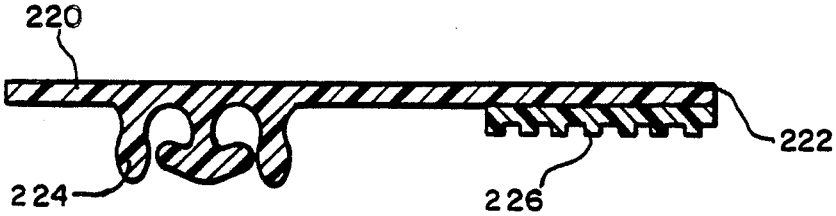
FIG. 6 is a cross sectional view of a third embodiment of a profile strip that may be used in the package of FIG. 1.

FIG. 6 shows one part of a third preferred embodiment of the invention, profile strip 220 (matching profile strips such as strip 30 of FIG. 3 would also be provided.) Again, profile strip 220 is very similar to the profile strip 20 of FIG. 3 (thus similar elements are numbered with the same reference numbers preceded by a 2). In the FIG. 6 embodiment, the heat barrier means comprises a heat resistant resin coextruded on a section of the front side of one or preferably both of the flange elements 222 and its unknown counterpart. The heat resistant resin has a higher softening point than the remainder of the flange element so that when the flange elements are heated during the film-flange sealing operation, the inside surfaces of the flange elements do not fuse together. For example, if the flanges are extruded from low density polyethylene, the heat resistant resin may be a polyester.

The temperatures and pressures used to seal the profile strips of FIGS. 3, 5 and 6 to the top and bottom films 12 and 14 will of course depend on the types of films used, their thicknesses, the resin used to make the profile strips, etc. These factors are commonly considered when appropriate process parameters are developed by those of ordinary skill in the art.

In the preferred embodiment of FIG. 1, the profile strips 20 and 30 are made of low density polyethylene (LLPE) containing a blend of 0–10%, preferably 2%, EVA. The LDPE will have a density of from 0.900–0.970 g/cm . The preferred LDPE had a density of 0.920–0.929 g/cm$^3$. Other heat sealable resins may also be used. Mated profile strips of the preferred embodiment of FIG. 3 weigh 3.3 grams per linear foot.

The total thickness of the thickened flange sections and ridges is preferably 10–24 mils, preferably at least 18 mils thick and most preferably 20 mils, with the thickened flange section itself being at least 5 mils thick. The ridges themselves are preferably 4–6 mils in height.

The preferred packaging films for use in processed meat application are Curwood Forming Web #579 for bottom film 14 and Curwood Nonforming Web #2580K for top film 12, both from Curwood, Inc. of Oshkosh, Wis. The overall film composition may of course vary with the application, and can either be monolayer, coextrusion or a laminate. The sealant layer is the layer important to the present invention. The preferred sealant layer is LDPE with 2–6% EVA blended in.

For this preferred embodiment, the sealing dwell time is from 0.5–5 sec., preferably 2 sec. Sealing temperatures are typically 200° F.–500° F., preferably 260° F.–30° F. Sealing pressures are typically 40–110 psi, preferably 80–100 psi.

In the embodiment of FIG. 5, the flange element 122 will be preferably 5–6 mils thick. The preferred buffer strip has two layers. The non-sealable layer could be nylon, polyester, paper or a similar material. The sealable layer could be polyethylene, SURLYN ® (an ionomer resin from DuPont) or a form of an adhesive (pressure sensitive, cold seal, hot melt, etc.).

In the embodiment of FIG. 6, the heat resistant resin will preferably be polyester, polyproplyene, polybutylene, SURLYN ® or other resin with a higher softening point than the softening point of the preferred LDPE/EVA resin blend used for the rest of the profile strip. The heat resistant layer will be from about 2–6 mils, preferably 2–4 mils thick. Though the remainder of the flange need be only thick enough to seal to the package film, as a practical matter it is preferred to have the LDPE/EVA portion of the flange element 5–6 mils thick, which is the minimum thickness of the profile. This makes it easier to have uniform coextrusion, since the die forming the profile strip must be machined in such a way as to also form the interlocking members.

The invention has been described in its use with a horizontal form, fill and seal process. However, the method of the invention could also be practiced in vertical form, fill and seal procedures, overwrapping, and adapted for other packaging equipment processes. The package could be formed from a folded sheet instead of two separate films. In that case the fold between the two film halves would replace one of seals 15. Also, the peel seal 18 could be outside the recloseable seal. In the preferred process of the invention, the heat seals 27 and 28 are made simultaneously on both sides of the package. However, using the profiles of the present invention makes it possible to form the heat seals while the flanges are together, regardless of whether they are simultaneous. It may be advantageous, where existing equipment can be used with simple modification, to seal the top film 12 to profile strip 20 at one point and seal film 14 to profile strip 30 at a subsequent point.

These and other modifications are within the scope of the present invention. It is for that reason that the following claims are used to define the present invention.

We claim:

1. A recloseable package comprising:

a) film walls sealed to each other and to recloseable profile strips located along one side of said film walls to form the package, b) the recloseable profile strips each comprising:

i) a flange element having a front and back side; and ii) a recloseable means element on the front side of the flange element; and c) a heat barrier means forming a part of the recloseable profile strips and associated with the front side of at least one of the flange elements sufficient so that at least one of the film walls may be heat sealed to the respective back side of the pair of recloseable profile strips while the recloseable means elements of the profile strips are mated, without also fusing the flange elements of the recloseable profile strips in the area of the heat barrier, due to the presence of said heat barrier.

2. The package of claim 1 wherein the heat barrier means comprises a thickened section of the flange element.

3. The package of claim 2 wherein the thickened section is between about 10 and 24 mils thick.

4. The package of claim 2 wherein ridges are formed on the thickened section so as to be between the flanges of mated profile strips and wherein the ridges contribute about 4 to 6 mils of the flange section thickness and the remainder of the thickened section is a minimum of 5 mils thick.

5. The package of claim 1 wherein the heat barrier means comprises a buffer strip.

6. The package of claim 5 wherein the buffer strip is made of a material selected from the group consisting of paper, foil, metallized plastic, and plastic having a higher softening point than that of the flange element.

7. The package of claim 1 wherein the profile strips each comprise an extruded resin, the heat barrier means comprises a resin coextruded with the resin of at least one of the profile flanges so as to be between the flanges of the mated profile strips, and wherein the softening point of the resin comprising the heat barrier means is higher than that of the resin forming the coextruded flange portion of the profile strip.

8. The package of claim 7 wherein the resin comprising the heat barrier means is coextruded on the flange of only one of the profile strips.

9. The package of claim 7 wherein the extruded resin comprises a blend of low density polyethylene and 0–10% EVA and the resin comprising the heat barrier means is selected from the group consisting of polyester, polypropylene, polybutylene and ionomer.

10. The package of claim 9 wherein the blend comprises about 2% EVA.

11. The recloseable package of claim 1 wherein the heat barrier means is sufficient so that both of the film walls may be simultaneously heat sealed to the respective back sides of the pair of strips while the strips are mated without also fusing the flange elements of the strips to each other.

12. A profile strip for use in making recloseable packages, the profile strip comprising:

a) a flange element having a front and back side;

b) a recloseable means element on the front side of the flange element; and c) a heat barrier means forming a part of the profile strip and associated with the front side of the flange element, said heat barrier means being functional so that a film may be heat sealed to the back side of the profile strip while the profile strip is mated to a corresponding profile strip without also fusing the flange elements of the two mated profile strips in the area of the heat barrier, due to the presence of said heat barrier means.

13. The profile strip of claim 12 wherein the heat barrier means comprises a thickened section of the flange element.

14. The profile strip of claim 13 wherein the thickened section is between about 10 and 24 mils thick.

15. The profile strip of claim 13 wherein ridges are formed on the thickened section so as to be between the flanges of mated profile strips and wherein the ridges contribute about 4 to 6 mils of the flange section thickness and the remainder of the thickened section is a minimum of 5 mils thick.

16. The profile strip of claim 12 wherein the profile strip comprises an extruded resin and the heat barrier means comprises a resin coextruded with the resin of the front side of the flange element and wherein the softening point of the resin comprising the heat barrier means is higher than the softening point of the resin of the coextruded flange element.

17. The profile of claim 16 wherein the flange element comprises a blend of low density polyethylene and 0–10% EVA and the resin comprising the heat barrier means is selected from the group consisting of polyester, polypropylene, polybutylene and ionomer.

18. The profile of claim 17 wherein the blend comprises about 2% EVA.

19. The profile of claim 12 wherein the heat barrier means comprises a buffer strip.

20. The profile of claim 19 wherein the buffer strip is made of a material selected from the group consisting of paper, foil, metallized plastic, and plastic having a higher softening point than that of the flange element.

21. The profile strip of claim 12 wherein the heat barrier means is functional so that a film may be heat sealed to the back side of the profile strip simultaneous to another film being heat sealed to the back side of a mated, corresponding profile strip without also fusing the flange elements of the two mated profile strips to each other.

22. The profile strip of claim 12 wherein the profile strip carries two sets of recloseable means elements on the front side of the flange element.

23. A recloseable plastic package including:

a) a first package wall;

b) a second package wall joined to said first package wall to define a container openable at one side for insertion or removal of product;

c) a pressure fastenable and releasable closure mechanism disposed between said first and second package walls adjacent said openable side of said container;

d) a seal between said first and second package walls disposed parallel to said releasable closure mechanism and disposed between said releasable closure mechanism and said product;

e) a first flange member extending from said first package wall outwardly of said closure mechanism;

f) a second flange member extending from said second package wall outwardly of said closure mechanism and adjacent and separated from said first flange member;

g) heat barrier means including a buffer strip disposed between said first and second flange members, and forming part of one of the flange members, said strip having a first surface which is sealable to either said first or second flange member and a second surface which is sealable to neither said first flange member nor said second flange member, said strip acting as a buffer between said first and second flange members such that when heat is applied to said package to seal said closure mechanism to said first and second package walls, said buffer strip is operative to prevent said flange members from sealing to each other and to maintain said flange members in a separated condition to facilitate release of said closure mechanism to open said package.

* * * * *

UNITED STATES PATENT AND TRADEMARK OFFICE

CERTIFICATE OF CORRECTION

PATENT NO. : 5,067,822

DATED : November 26, 1991

INVENTOR(S) : Lawrence W. Wirth et al

It is certified that error appears in the above-identified patent and that said Letters Patent is hereby corrected as shown below:

In column 5, line 43, please delete "LLPE" and substitute therefor--(LPDE)--: line 45, please delete "g/cm" and substitute therefor --g/$cm^3$--.

Signed and Sealed this

Fifth Day of October, 1993

*Attest:*

*Attesting Officer*

BRUCE LEHMAN

*Commissioner of Patents and Trademarks*